US009194191B2

(12) United States Patent
Smith et al.

(10) Patent No.: US 9,194,191 B2
(45) Date of Patent: Nov. 24, 2015

(54) LINK CARRIER APPARATUS FOR A DRILLING RIG

(75) Inventors: Logan Essex Smith, Lafayette, LA (US); Jeremy Richard Angelle, Lafayette, LA (US); Robert Thibodeaux, Jr., Lafayette, LA (US)

(73) Assignee: Frank's International, LLC, Houston, TX (US)

( * ) Notice: Subject to any disclaimer, the term of this patent is extended or adjusted under 35 U.S.C. 154(b) by 808 days.

(21) Appl. No.: 13/403,659

(22) Filed: Feb. 23, 2012

(65) Prior Publication Data

US 2012/0217066 A1 Aug. 30, 2012

Related U.S. Application Data

(60) Provisional application No. 61/447,522, filed on Feb. 28, 2011.

(51) Int. Cl.
*E21B 19/18* (2006.01)
*E21B 19/00* (2006.01)
*E21B 19/06* (2006.01)

(52) U.S. Cl.
CPC ..... *E21B 19/00* (2013.01); *E21B 19/06* (2013.01)

(58) Field of Classification Search
CPC ..... E21B 2119/00; E21B 19/06; E21B 19/14
USPC ..... 175/57, 85; 294/90, 102.2; 414/22.57, 414/22.51, 22.68, 22.58; 166/77.52
See application file for complete search history.

(56) References Cited

U.S. PATENT DOCUMENTS

| | | | | | |
|---|---|---|---|---|---|
| 3,063,509 | A * | 11/1962 | Guier | 175/85 |
| 3,308,970 | A * | 3/1967 | Hart et al. | 414/22.51 |
| 4,326,745 | A * | 4/1982 | Guier | 294/90 |
| 4,421,447 | A * | 12/1983 | Gudgel et al. | 414/22.68 |
| 4,439,091 | A * | 3/1984 | Frias | 414/22.59 |
| 6,079,925 | A * | 6/2000 | Morgan et al. | 414/22.57 |
| 7,296,630 | B2 * | 11/2007 | Severin et al. | 166/379 |
| 7,314,090 | B2 * | 1/2008 | Thomas et al. | 166/380 |
| 2013/0037324 | A1 * | 2/2013 | Milivojevic et al. | 175/24 |

* cited by examiner

*Primary Examiner* — Kenneth L Thompson
*Assistant Examiner* — Michael Wills, III
(74) *Attorney, Agent, or Firm* — Osha Liang LLP

(57) ABSTRACT

An apparatus, a system, and a method to secure a link in a drilling rig. The apparatus includes a carrier configured to removably secure at least a portion of the link therein, in which the carrier is configured to have a first end of the link accessible outside of the carrier. Further, the system includes a tool having a link ear and suspended within the drilling rig, the link ear configured to attach a first end of the link thereupon, and a carrier configured to removably secure at least a portion of the link, in which the first end of the link is accessible to attach to the link ear.

32 Claims, 12 Drawing Sheets

LINK CARRIER APPARATUS FOR A DRILLING RIG

CROSS-REFERENCE TO RELATED APPLICATIONS

This application claims benefit, under 35 U.S.C. §119, of U.S. Provisional Application Ser. No. 61/447,522, filed on Feb. 28, 2011, and entitled "Link Carrier Apparatus for a Drilling Rig." The disclosure of this U.S. Provisional Application is incorporated herein by reference in its entirety.

BACKGROUND OF DISCLOSURE

1. Field of the Disclosure

Embodiments disclosed herein generally relate to methods and apparatus to secure a link in a drilling rig with a carrier. More specifically, embodiments disclosed herein relate to apparatus that are used to secure a link from a drilling rig and/or secure a link within a drilling rig, such as secure a link with a carrier configured to move within a drilling rig.

2. Background Art

In oilfield exploration and production operations, various oilfield tubular members are used to perform important tasks, including, but not limited to, drilling the wellbore and casing a drilled wellbore. For example, a long assembly of drill pipes, known in the industry as a drill string, may be used to rotate a drill bit at a distal end to create the wellbore. Furthermore, after a wellbore has been created, a casing string may be disposed downhole into the wellbore and cemented in place to stabilize, reinforce, or isolate (among other functions) portions of the wellbore. As such, strings of drill pipe and casing may be connected together, such as end-to-end by threaded connections, in which a female "pin" member of a first tubular member is configured to threadably engage a corresponding male "box" member of a second tubular member. Alternatively, a casing string may be made-up of a series of male-male ended casing joints coupled together by female-female couplers. The process by which the threaded connections are assembled is called "making-up" a threaded connection, and the process by which the connections are disassembled is referred to "breaking-out" the threaded connection. As would be understood by one having ordinary skill, individual pieces (or "joints") of oilfield tubular members may come in a variety of weights, diameters, configurations, and lengths.

Referring to FIG. 1, a perspective view is shown of a drilling rig 101 used to run one or more tubular members 111 (e.g., casing, drill pipe, etc.) downhole into a wellbore 113. As shown, the drilling rig 101 includes a frame structure known as a "derrick" 102, in which a traveling block 103, a lifting apparatus 105 (e.g., an elevator), a supporting apparatus 107 (e.g., slip assembly or spider), and/or a top drive 145 may be used to manipulate (e.g., raise, lower, rotate, hold, etc.) a tubular member 111. The traveling block 103 is a device that is suspended from at or near the top of the derrick 102, in which the traveling block 103 may move up-and-down (e.g., vertically as depicted) to raise and/or lower the tubular member 111. The traveling block 103 may be a simple "pulley-style" block and may have a hook from which objects below (e.g., lifting apparatus 105 and/or top drive) may be suspended.

Additionally, the lifting apparatus 105 may be coupled below the traveling block 103 and/or the top drive 145 to selectively support and/or release a tubular member 111 as the tubular member 111 is to be raised and/or lowered within and from the derrick 102. As such, and as shown in FIG. 1, the drilling rig 101 may include one or more guiding rails 108 and/or a track disposed adjacent to the top drive 145, in which the guiding rails 108 or track may be used to support and guide the top drive 145 (e.g., from which the lifting apparatus 105 may be suspended) as the top drive 145 is raised and/or lowered within the derrick 102. An example of a top drive is disclosed within U.S. Pat. No. 4,449,596, filed on Aug. 3, 1982, and entitled "Drilling of Wells with Top Drive Unit," which is incorporated herein by reference in its entirety.

The lifting apparatus 105 may include one or more movable engagement members (e.g., slip assemblies), in which the members may be attached to the lifting apparatus 105 and movable between an open position and a closed position. In the closed position, the lifting apparatus 105 supports the tubular member 111 such the tubular member 111 may be lifted and/or lowered. In the open position, the lifting apparatus 105 may release the tubular member 111 and move away therefrom to allow the tubular member 111 to be engaged with or removed from the lifting apparatus 105 and/or the supporting apparatus 107. For example, the lifting apparatus 105 may release the tubular member 111 after the tubular member 111 is threadably connected to a tubular string 115 and/or supported by the supporting apparatus 107 of the drilling rig 101.

In FIG. 1, the drilling rig 101 may include a top drive 145 having one or more link ears 147 (e.g., bail ears) supporting the lifting apparatus 105 (e.g., an elevator) through one or more links 151 (e.g., bails) disposed therebetween. Further, the supporting apparatus 107 of the drilling rig 101 may be used to support the tubular string 115, such as by having gripping and/or supporting engagement with the tubular string 115, from the drilling rig 101 (e.g., supported by the rig floor 109 or by a rotary table thereof). The supporting apparatus 107 may be disposed within (e.g., be supported by) the rig floor 109, such as flush with the rig floor 109, may extend (e.g., be supported by) above the rig floor 109, as shown, and/or may be supported otherwise by the drilling rig, such as suspended from a component of the drilling rig. As such, the supporting apparatus 107 may be used to suspend the tubular string 115, e.g., while one or more tubular members 111 are connected or disconnected from the tubular string 115.

A reverse process, or one similar to the process described above, may be used, such as to remove one or more tubular members 111 from the drilling rig 101. As such, when removing a tubular member 111 from the drilled wellbore (e.g., beneath drilling rig 101), the tubular string 115 may be raised into the derrick 102 to have the tubular member 111 extending above the supporting apparatus 107 and rotary table 109. The supporting apparatus 107 may be used to support the remainder of the downhole string 115 below the rotary table 109, in which the tubular member 111 may be threadably disconnected from the downhole string 115. For example, the supporting apparatus 107 may support the tubular member 111 and the top drive 145, and/or another component, such as tubular tongs, may rotate the tubular member 111 to threadably disconnect the tubular member 111 from the downhole string 115. The lifting apparatus 105, or other mechanism or device, may transport the tubular member 111 out of the derrick 102 of the drilling rig 101, e.g., to have the tubular member 111 placed upon the pipe rack 112.

As such, depending on the particular activity within the drilling rig 101, such as depending on the weight of the tubular members 111 used within the drilling rig 101, the link(s) 151 used within the drilling rig 101 may need to be removed, replaced, and/or otherwise switched out. This process may enable links of various other shapes and sizes to be used within the drilling rig 101, as appropriate. However, when "rigging up" and/or "rigging down" the links 151, the links 151 may be heavy enough such that handling the links may be difficult, and further the removing and installing of the links may be time consuming. Accordingly, there exists a need to be able to remove and/or install links within a drilling rig in an easier and quicker manner.

SUMMARY OF INVENTION

In a first aspect, embodiments disclosed herein relate to a system to secure a link in a drilling rig. The system includes a tool having a link ear and suspended within the drilling rig, the link ear configured to attach a first end of the link thereupon, and a carrier configured to removably secure at least a portion of the link, in which the first end of the link is accessible to attach to the link ear.

In another aspect, embodiments disclosed herein relate to an apparatus to secure a link in a drilling rig. The apparatus includes a carrier configured to removably secure at least a portion of the link therein, in which the carrier is configured to have a first end of the link accessible outside of the carrier.

In another aspect, embodiments disclosed herein relate to a method to secure a link from a drilling rig. The method includes providing a tool having a link ear within the drilling rig, the link ear having a first end of the link attached thereupon, disposing a carrier adjacent to the tool, receiving at least a portion of the link within the carrier such that the link is secured within the carrier, and moving the carrier away from the tool with the link secured within the carrier.

In another aspect, embodiments disclosed herein relate to a method to secure a link to a drilling rig. The method includes providing a tool having a link ear within the drilling rig, the link ear configured to have a first end of the link attached thereupon, disposing a carrier adjacent to the tool, the carrier having the link removably received therein, attaching the first end of the link to the link ear of the tool, releasing the link from the carrier, and moving the carrier away from the tool with the link attached to the link ear of the tool.

Other aspects and advantages of the invention will be apparent from the following description and the appended claims.

DETAILED DESCRIPTION

Figure 1:
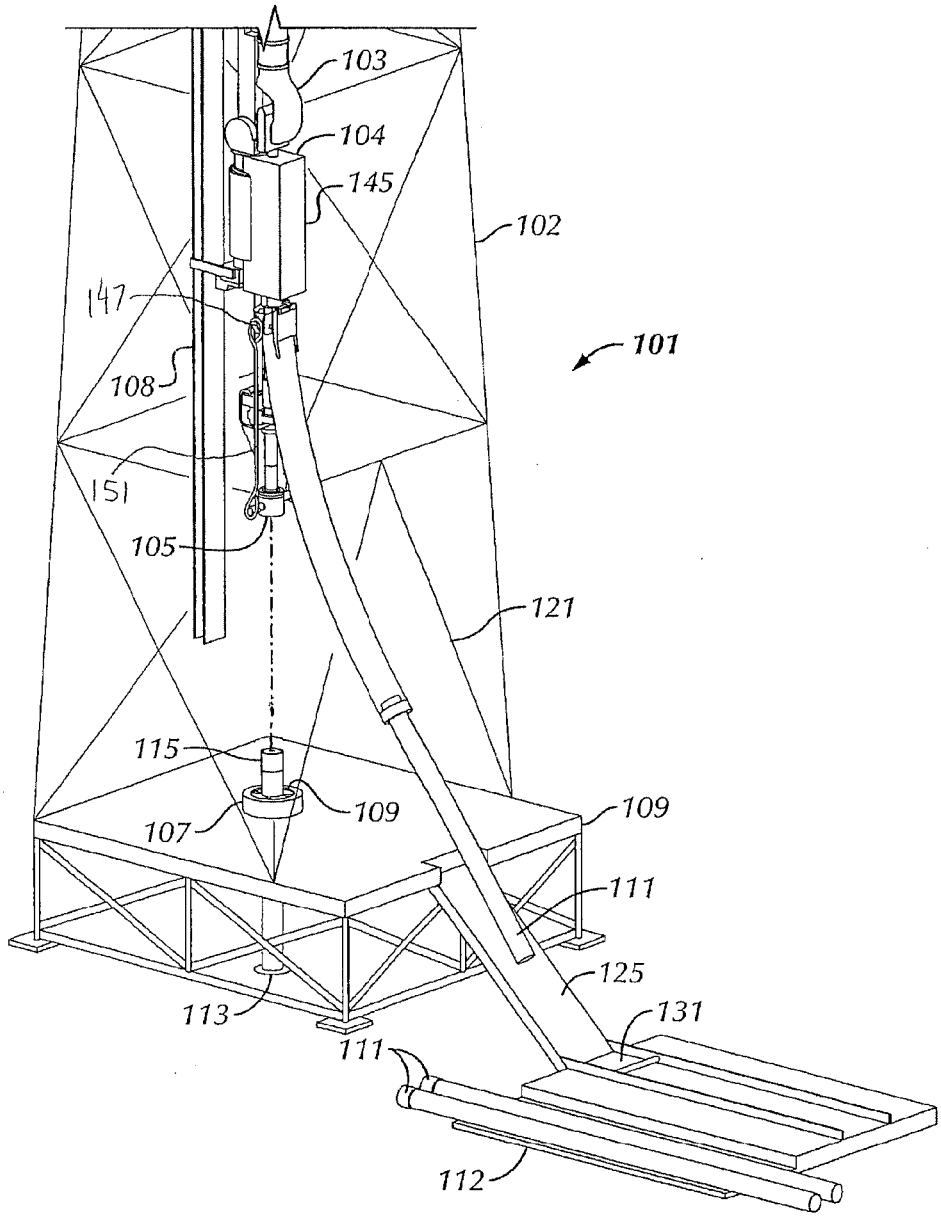
FIG. 1 PRIOR ART
FIG. 1 shows a schematic view of a drilling rig.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description.

As used herein, a "link" may refer to a member, such as a cylindrical shaped bar, that may be attached to and/or disposed between multiple components suspended within a drilling rig. For example, a link may refer to a member that may be used to suspend one tool, such as an elevator, from another tool, such as a top drive, within a drilling rig. A link, also commonly referred to as a bail, may include a first end and a second end, in which one of the ends of the link may attach to a link ear of a tool, also commonly referred to as a bail ear, (e.g., by having a slot therein the link to receive the elevator attachment (ear) and/or link attachment (ear) of the drawworks) and the other of the ends of the link may attach to another tool (e.g., connected to the drawworks).

Further, the link may be formed as having a single component, such as having the link monolithic in structure, and/or the link may be formed as having multiple components. For example, in one or more embodiments, a link may have one or more components attached thereto to have multiple components, such as a knuckle link and/or an elevator installed with and/or connected to the link. Accordingly, the present disclosure contemplates one or more embodiments in which an apparatus of the present disclosure may be used to secure a link from a drilling rig, in which the "link" may and/or may not include a knuckle link, an elevator, and/or any other tool or component attached thereto.

In one aspect, embodiments disclosed herein generally relate to a method, a system, and/or an apparatus used to secure a link in a drilling rig. A tool having a link ear may be suspended within the drilling rig, in which the link ear of the tool may be used to attach a first end of the link thereupon. A carrier may be used to removably receive at least a portion of the link therein, such as by having the first end of the link accessible outside of the carrier and a second end of the link secured within the carrier. Further, the carrier may be able to move with respect to the tool, such as by having the carrier move towards and away from the tool to transport the link within the drilling rig.

Figure 2A:
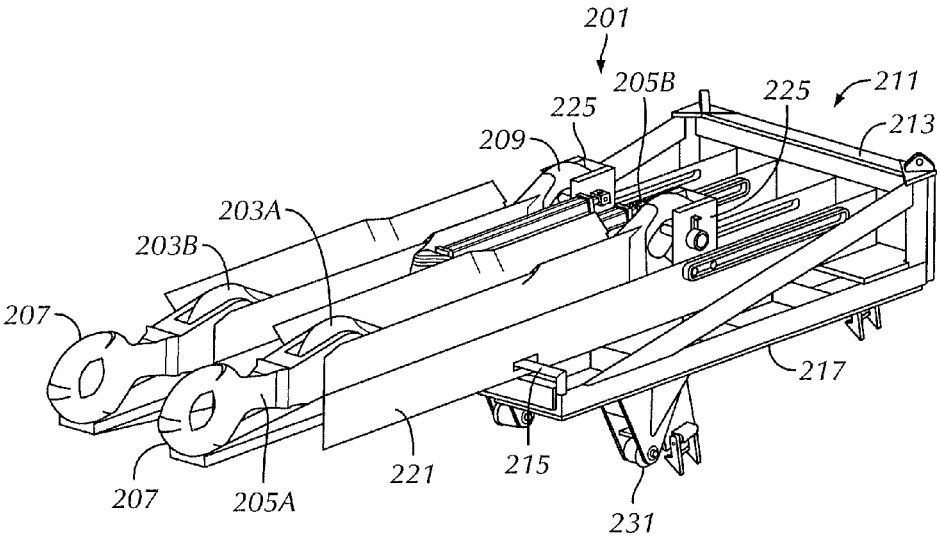
FIGS. 2A-2F show multiple views of a carrier in accordance with one or more embodiments of the present disclosure.
Figure 2B:
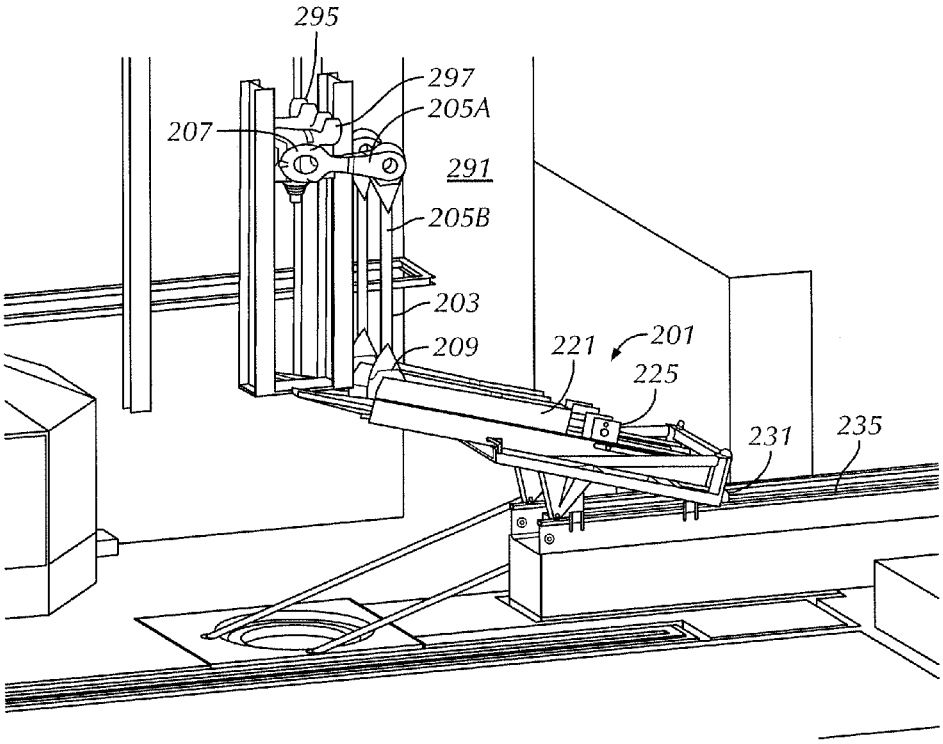
Figure 2C:
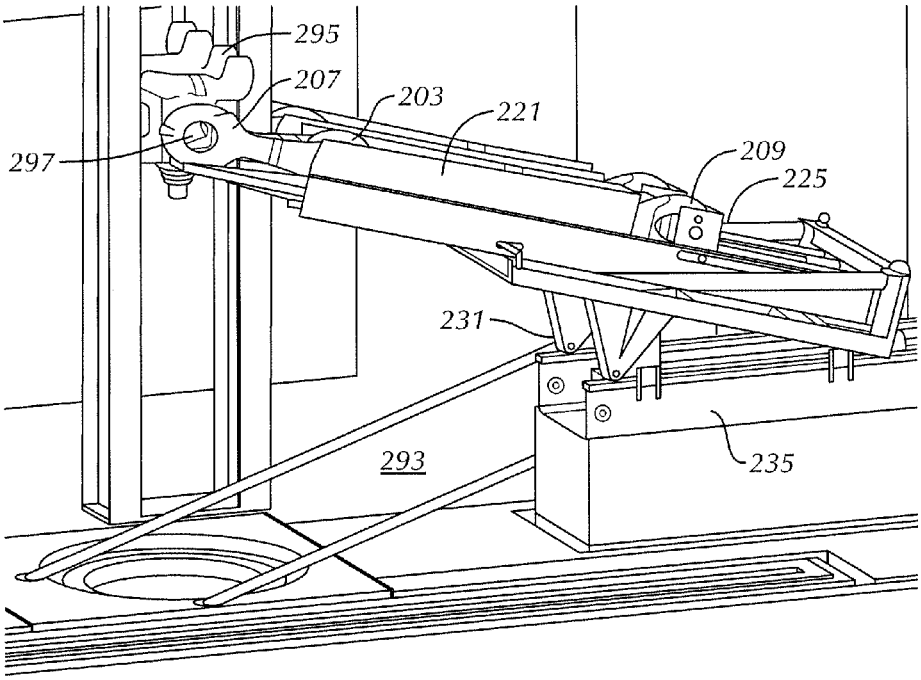
Figure 2D:
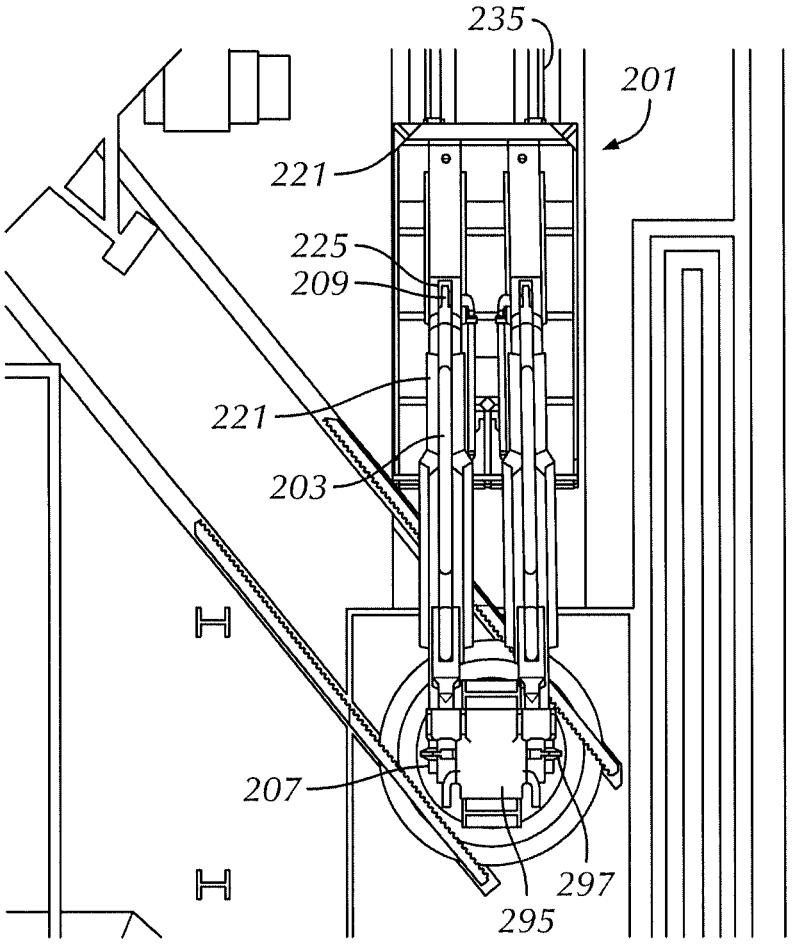

Referring now to FIGS. 2A-2F, multiple views of a carrier 201 in accordance with one or more embodiments disclosed herein are shown. Specifically, FIG. 2A shows a perspective view of only the carrier 201, and FIGS. 2B-2F show the carrier 201 used within a drilling rig 291. The carrier 201 may be used to removably receive one or more links 203 therein, such as removably receive at least a portion of a first link 203A therein and/or removably receive at least a portion of a second link 203B therein. Accordingly, the carrier 201 may be used to transport one or more links 203 within the drilling rig 291, such as transport the links 203 towards and/or away from a tool 295 suspended within the drilling rig 291. The tool 295 may include one or more link ears 297 formed thereon and/or attached thereto, in which the links 203 may attach (e.g., substantially simultaneously) to the link ear 297 of the tool 295. For example, in one embodiment, only one link 203 may attach to the tool 295, and/or in another embodiment, multiple links 203, such as shown in FIGS. 2A-2F, may be attached to the tool 295, such as by having the links 203 attached at substantially the same time to the tool 295. Alternatively, the links 203 may be attached individually, such as one at a time, to the tool 295. As such, the tool 295 may include any tool known in the art, such as a top drive, that may have one or more link ears 297 formed thereon and/or attached thereto.

As discussed above, the links may be formed from a single component, and/or may be formed from multiple components attached together. As such, and as shown in FIGS. 2A-2F, one or more of the links 203 may be formed from multiple components 205 attached together. Particularly, in FIGS. 2A-2F, the links 203 may include a first smaller component 205A, such as a knuckle link, attached to a larger component 205B, such as larger link. Accordingly, for convenience, only the foremost ends of the links 203 are specifically referred to in the present application, in which the links 203 may include a first end 207 and a second end 209. As shown in FIGS. 2A-2F, the first end 207 of the link 209 may be used to attach to the link ear 297 of the tool 295, and the second end 209 of the link 209 may be secured within the carrier 201.

The carrier 201 may include a body 211, such as a frame and/or other structure, in which the body 211 may be used to provide support for the carrier 201. Further, the carrier 201 may include one or more link retainers 221, in which the link retainers 221 may be used to receive and retain the links 211 therein. As such, in one or more embodiments, the link retainers 221 may be able to support and/or partially encompass the links 211 to receive and retain the links 211 therein. The link retainers 221 may be attached to the body 211, such as movably attached to the body 211. For example, the link retainers 221 may be pivotally attached on one side 213 of the body 211, thereby enabling the link retainers 221 to be slidably attached to another side 215 of the body 211 (as shown), and/or enabling the link retainers 221 to be otherwise separate and independent of the body 211.

Further, the carrier 201 may include one or more securing mechanisms 225, in which the securing mechanisms 225 may be used to removably receive and secure the link 203 in the carrier 201. For example, the securing mechanisms 225 may be used to secure an end, such as the second end 209, of the links 203 therein. The securing mechanisms 225, as shown, may include a housing with a bolt therethrough to secure the second end 209 of the link 203 therein. However, those having ordinary skill in the art will appreciate that the present disclosure is not so limited, as other securing mechanisms, such as, but not limited to straps, clamps, fasteners, etc., such as any component that may releasably secure the link to the carrier, may be used without departing from the scope of the present disclosure. Such securing mechanisms may be manually operated and/or include an actuator, e.g., for remote control.

In one or more embodiments, the carrier of the present disclosure may be used to move the link with respect to the body of the carrier, such as by moving the link within the carrier between an extended position and a retracted position. For example, in FIGS. 2A-2F, the securing mechanisms 225 may be disposed within and movably attached to the link retainers 221. As such, as the securing mechanisms 225 may be movably attached to the link retainers 221, the securing mechanisms 225 may be able to move between an extended position, as shown in FIG. 2A, and a retracted position, as shown in FIG. 2F. In the extended position, the ends 207 of the links 203 may be exposed from the link retainers 221 and the carrier 201 such that the ends 207 may be accessible outside of the carrier 201. For example, if the ends 207 of the links 203 are accessible outside of the carrier 201, the ends 207 of the links 203 may be attached to the link ear 297 though the other ends 209 of the links 203 are secured within the securing mechanisms 225. Further, in the retracted position, the ends 207 of the links 203 may be disposed within the carrier 201, such as disposed within the link retainers 221 of the carrier 201.

As discussed above, the carrier may be able to move within a drilling rig. As such, and referring still to FIGS. 2A-2F, the carrier 201 may include one or more roller members 231 (e.g., cogs or wheels) disposed on a side thereof. Particularly, in one embodiment, the roller members 231 may be disposed on a bottom side 217 of the body 211 of the carrier 201. The roller members 231 may be used to facilitate movement of the carrier 201 such that the carrier 201 may be used to transport the links 203 therein. For example, as shown in FIGS. 2A-2F, a track 235 may be included within the drilling rig 291, such as by having the track 235 elevated above a rig floor 293 of the drilling rig 291 and/or having the track 235 disposed within the rig floor 293 of the drilling rig 291. The carrier 201 may be able to move along the track 235, such as to have the roller members 231 engage the track 235 to guide the carrier 201 towards and/or away from the tool 295. Alternatively, rather than including the track 235, the carrier 201 may be able to move along the rig floor 293, such as by having the roller members 231 engage and roll along the rig floor 293 to guide the carrier 201 towards and/or away from the tool 295.

In accordance with one or more embodiments disclosed herein, one or more components of the carrier of the present disclosure may be pneumatically actuated, hydraulically actuated, electrically actuated, mechanically actuated, combinations thereof and/or the like, to secure one or more links within the carrier. For example, as shown particularly in FIG. 2E, one or more actuators 241 may be included within the carrier 201 to facilitate movement of the carrier 201. Accordingly, those having ordinary skill in the art will appreciate that one or more actuators may be included within a carrier of the present disclosure. As such, a first actuator 241A may be coupled between the body 211 and the link retainers 221, thereby enabling the first actuator 241A to be able to move the link retainers 221 with respect to the body 211 of the carrier 201, e.g., to move at least a portion of the link retainers 221 (e.g., laterally and/or substantially simultaneously) towards and/or away from each other. Further, a second actuator 241B may be coupled between the link retainers 221 and the securing mechanisms 225, thereby enabling the second actuator 241B to move the securing mechanisms 225 with respect to the carrier 201. Accordingly, one or more actuators may be used to move one or more link retainers laterally within the drilling rig, thereby moving the links and/or link retainers towards and/or away from the tool supported within the drilling rig. As shown, in one or more embodiments, the actuators may also be used to impart multiple degrees of freedom of movement upon the link retainers of the carrier. As such, the actuators 241A may be used to move the link retainers 221 towards and/or away from the tool 295 in a first direction, and the actuators 241B may be used to move the link retainers 221 towards and/or away from the tool 295 in a second direction substantially perpendicular to the movement of the first direction.

Those having ordinary skill in the art will appreciate that the present disclosure contemplates one or more methods to secure one or more links in a drilling rig. As such, and referring now to FIGS. 2B-2F, a method of removing and rigging down one or more links 203 within a drilling rig 291 is shown. Beginning with FIG. 2B, the carrier 201 may be disposed adjacent to the tool 295, in which the links 203 may be attached at the ends 207 to the link ears 297 of the tool 295. Further, the other ends 209 of the links 203 may be disposed within the carrier 201, such as disposed within the link retainers 221 of the carrier 201. The tool 295 may then be lowered within the drilling rig 291, such as shown within FIGS. 2C and 2D, such that the links 203 may be more fully received into the carrier 201. Further, the links 203 may be secured within the carrier 201, such as by having the ends 209 of the links 203 secured within the securing mechanisms 225 of the carrier 201. As such, the links 203 are shown as in the extended position in FIG. 2C.

Figure 2E:
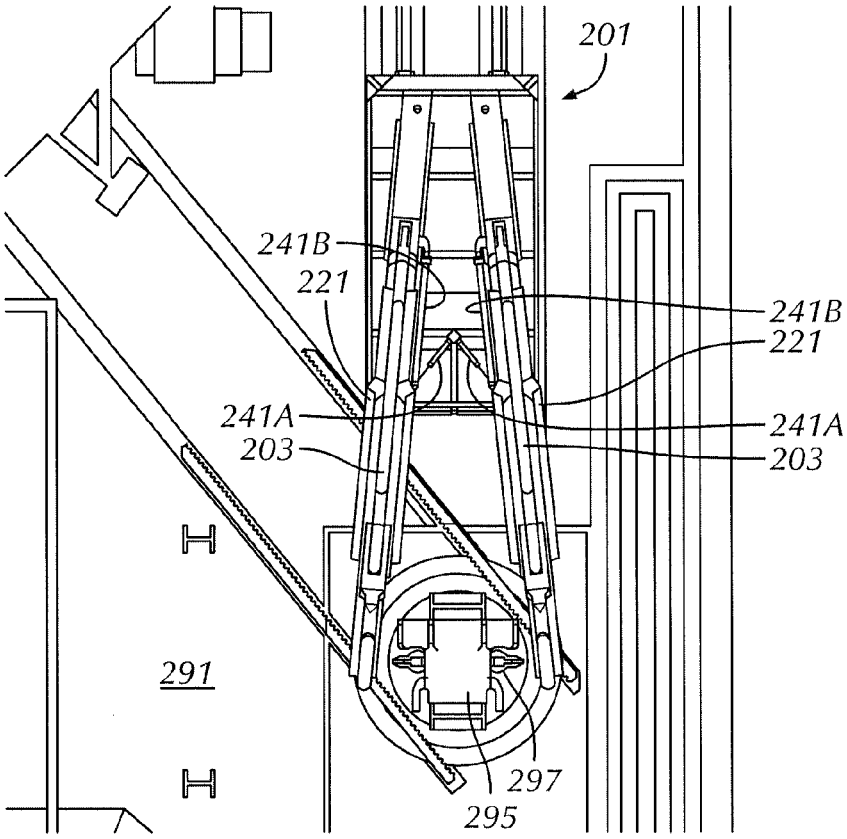
Figure 2F:
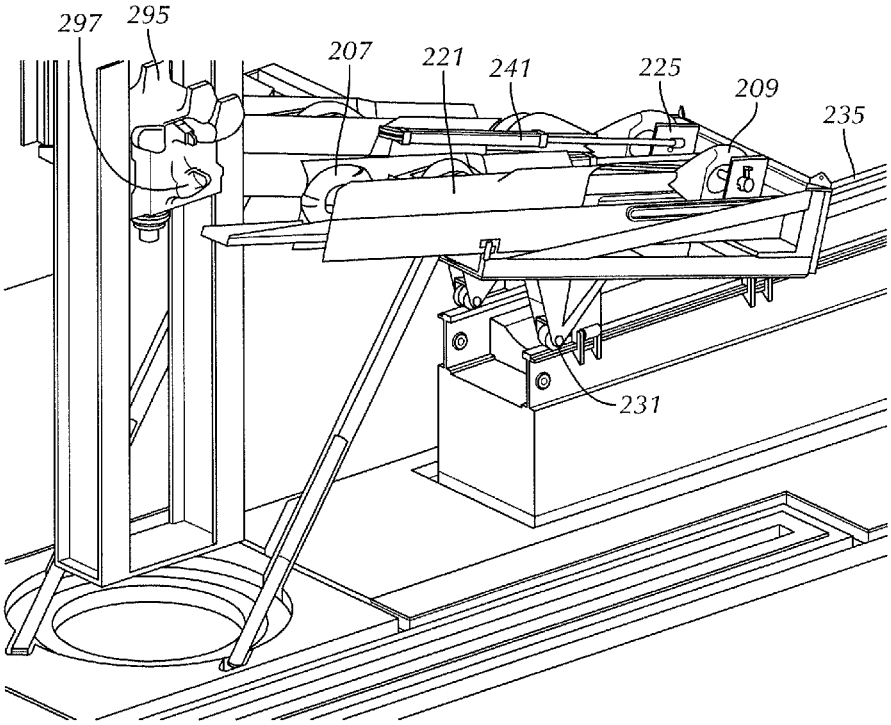

Continuing with FIG. 2E, the links 203 may be released from attachment with the tool 295. Particularly, as shown, the ends 207 of the links 203 may be released from attachment with the link ears 297 of the tool 295, such as by moving the link retainers 221 with the links 203 therein with respect to the link ears 297 of the tool 295. As discussed above, the actuators 241A may be used to move the link retainers 221 within the carrier 201, thereby facilitating releasing the links 203 from being coupled with the tool 295. Further, as shown in FIG. 2F, the links 203 may be moved within the carrier 201 from the extended position to the retracted position. Particularly, the securing mechanisms 225 having the ends 209 of the links 203 secured therein may move from the extended position to the retracted position, thereby moving the links 203 with the securing mechanisms 225. After securing the links 203 within the carrier 201, the carrier 201 may move within the drilling rig 291 to transport the links 203, such as by having the carrier 201 move along the track 235 and/or the rig floor 293.

Figure 3A:
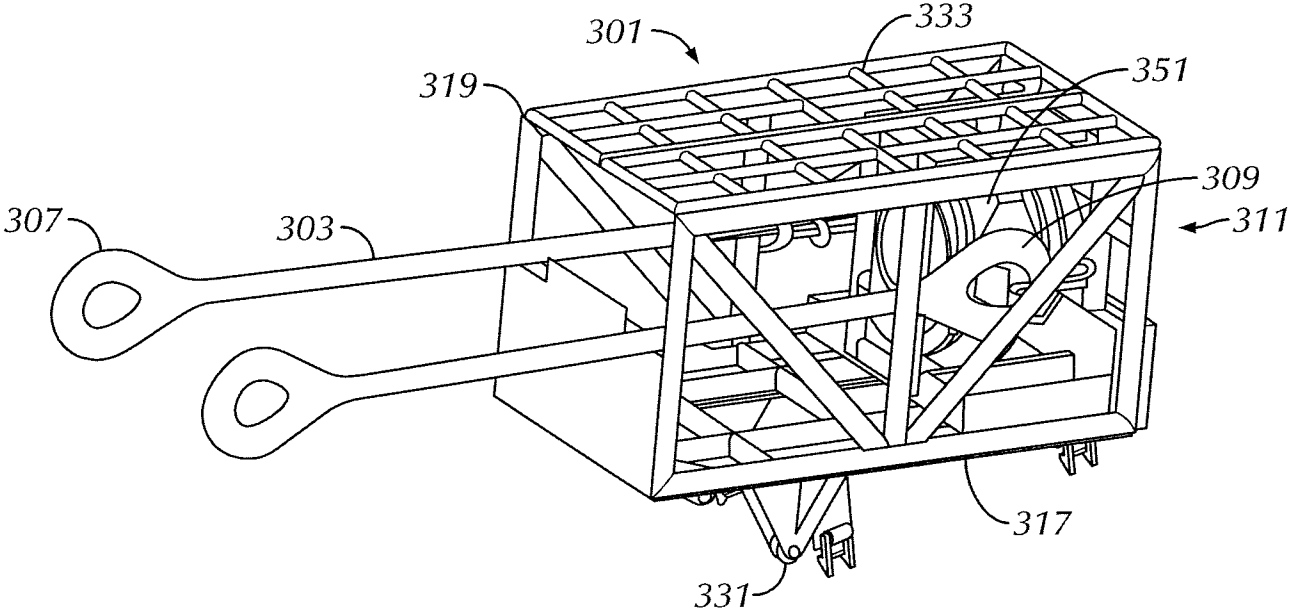
FIGS. 3A-3E show multiple views of a carrier in accordance with one or more embodiments of the present disclosure.

Referring now to FIGS. 3A-3E, multiple views of a carrier 301, e.g., comprising an offshore basket, in accordance with one or more embodiments disclosed herein are shown. Specifically, FIG. 3A shows a perspective view of only the carrier 301, and FIGS. 3B-3E show the carrier 301 used within a drilling rig 391. Similar to the carrier 201 discussed above, the carrier 301 may be used to removably receive one or more links 303 therein. Accordingly, the carrier 301 may be used to transport one or more links 303 within the drilling rig 391, such as transport the links 303 towards and/or away from a tool 395 suspended within the drilling rig 391.

As with the embodiment discussed above, the carrier 301 may include a body 311, in which roller members 331 may be disposed on a bottom side 317 of the carrier 301. Further, the carrier 301, as shown, may be used to have the ends 307 of the links 303 accessible from outside of the carrier 301, while the other ends 309 of the links 303 may be secured within the body 311 of the carrier 301. Furthermore, in addition to having the links 303 removably received within the carrier 301, another tool 351, such as an elevator and/or any other tool known in the art, may be attached to the links 303, and therefore also removably received within the carrier 301. As such, in addition to the carrier 301 facilitating the installation and removal of the links 303 with the tool 395, the carrier 301 may facilitate installation and removal of other tools 351 with the tool 395, e.g., those tools attached to links 303. Accordingly, a carrier of the present disclosure may be used to also transport a tool therein within a drilling rig.

Figure 3B:
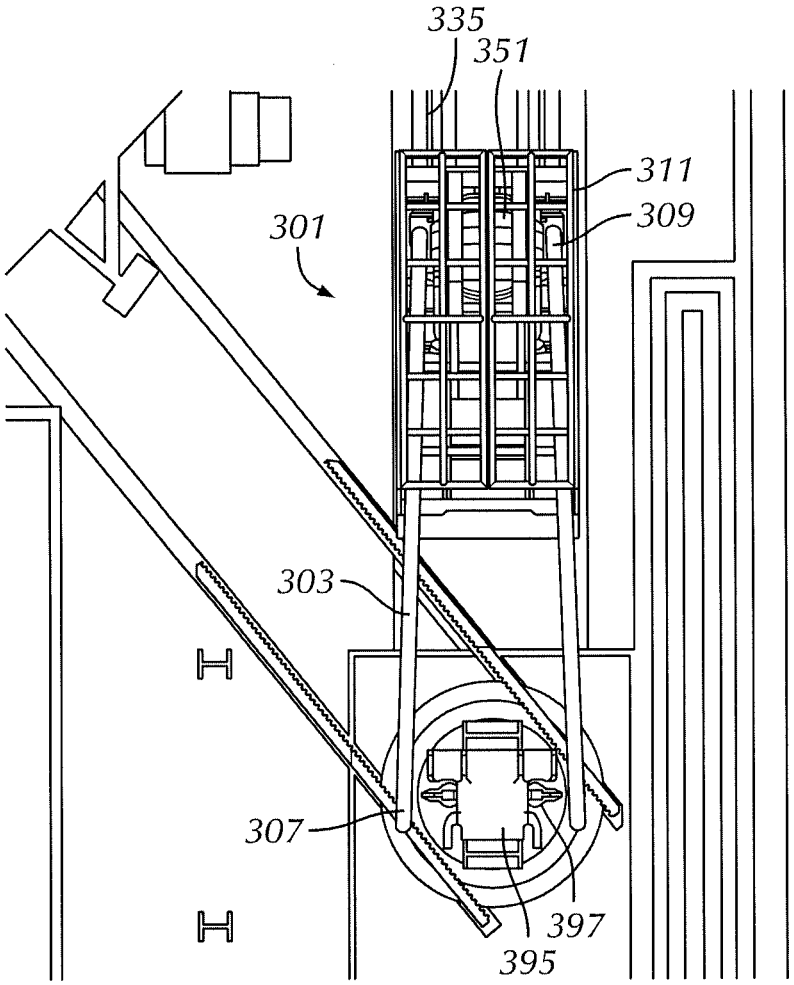
Figure 3C:
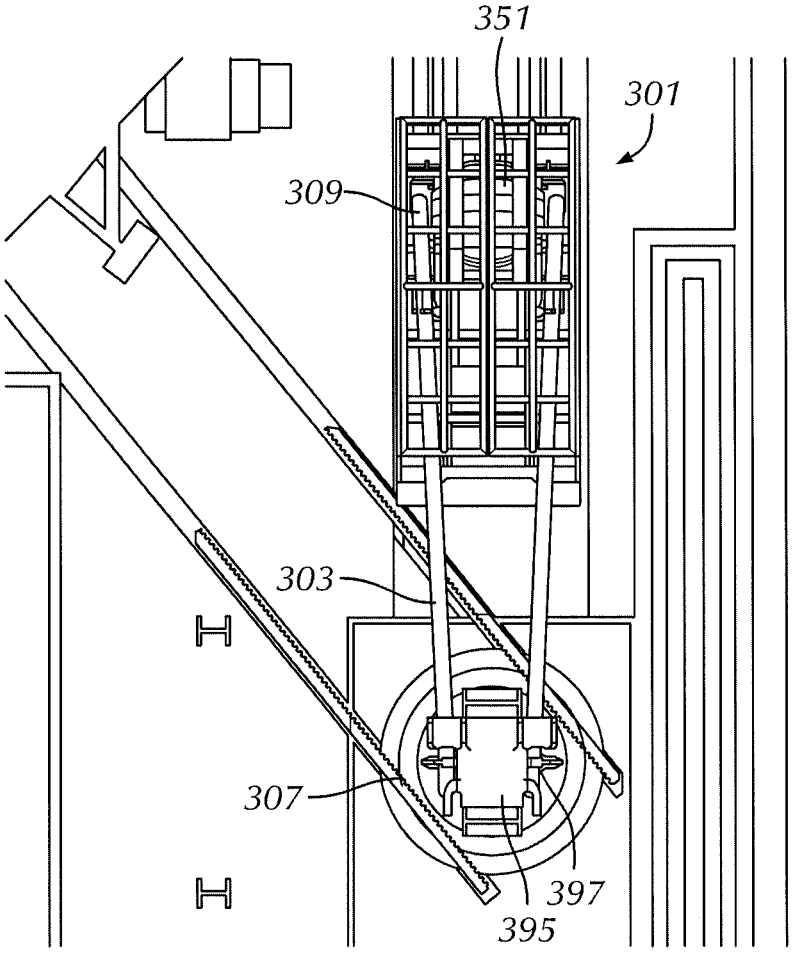

Referring now to FIGS. 3B-3E, a method of installing and rigging up one or more links 303 within a drilling rig 391 is shown. In this embodiment, the links 303 include the tool 351 (e.g., elevator) attached thereto. However, those having ordinary skill in the art will appreciate that other tools, or no tools at all, may be included with and attached to the links 303. Beginning with FIG. 3B, the carrier 301 having the links 303 and the tool 351 removably received therein may be disposed adjacent the tool 395. Particularly, the ends 307 (e.g., slots) of the links 303 may be disposed adjacent to the link ears 397 of the tool 395, as shown in FIG. 3B, and then the links 303 may be attached to the link ears 397 of the tool 395, as shown in FIG. 3C.

Figure 3D:
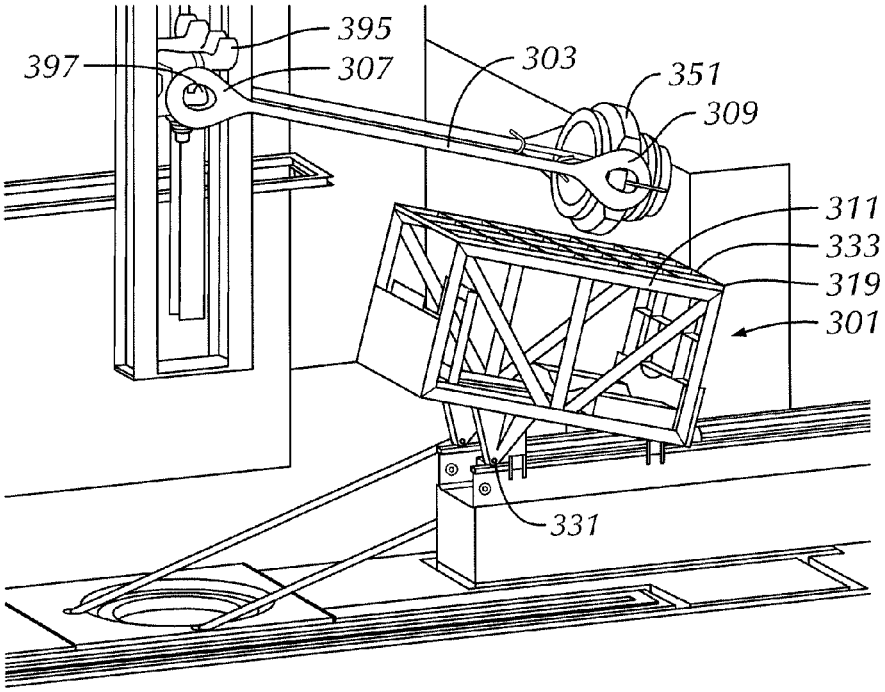
Figure 3E:
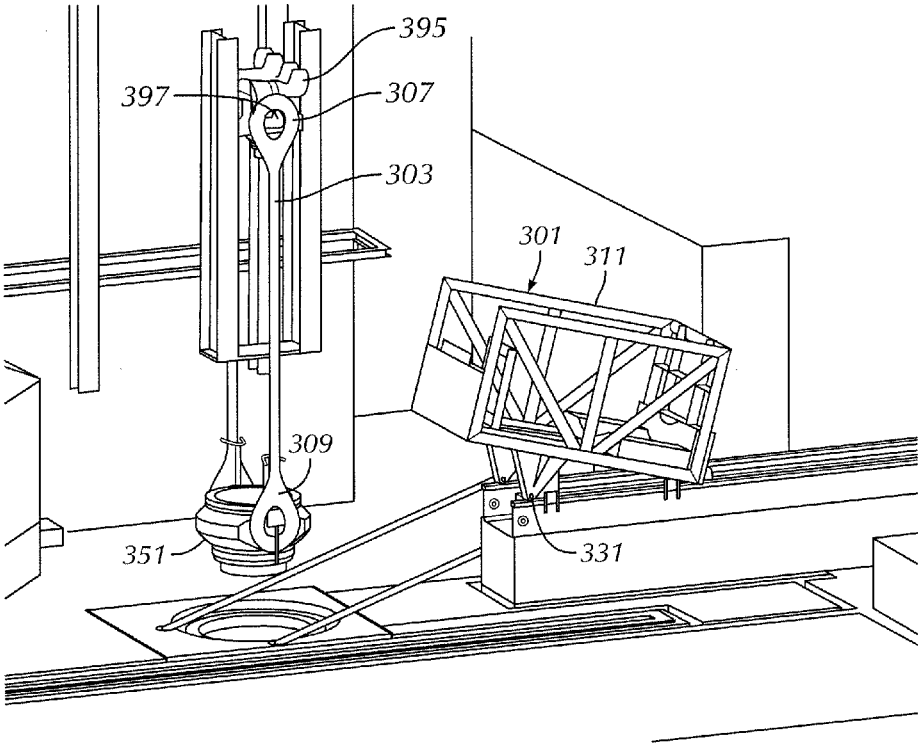

Continuing with FIG. 3D, the links 303, along with the tool 351 attached to the links 303, may be removed from the carrier 301. For example, the carrier 301 may include a door 333, such as disposed on a top side 319 of the body 311, in which the door 333 may open and close to retain and release the links 303 and/or the tool 351 therein. Accordingly, after the links 303 have been attached to the tool 395, the carrier 301 may be opened and the tool 395 may be raised to release the links 303 and/or the tool 351 therefrom. After the tool 395 has been raised a sufficient enough height, the links 303 and the tool 351 may be rotated such that the tool 351 is disposed substantially beneath the tool 395, as shown in FIG. 3E.

As shown in the above embodiments, the carrier of the present disclosure may take one or multiple forms and/or arrangements. As such, the present disclosure contemplates having other arrangements and structures for a carrier without departing from the scope of the present disclosure. For example, in one embodiment, the carrier may include one or more actuators to facilitate moving the carrier within the drilling rig. Further, in another embodiment, the carrier may be configured to receive other tools, components, and/or links without departing from the scope of the present disclosure. Accordingly, the present disclosure is not limited to only the embodiments disclosed above.

Embodiments disclosed herein may provide for one or more of the following advantages. First, embodiments disclosed herein may provide for a carrier that may be used to increase the safety when rigging links up and down within a drilling rig. For example, a carrier in accordance with the present disclosure may be capable of handling the heavier loads from the links, and any components attached to the links, thereby reducing the manual labor necessary when rigging links up and down within a drilling rig. Further, embodiments disclosed herein may provide for a carrier that may be used to quickly and efficiently receive and transport links within a drilling rig, thereby decreasing the overall time necessary for rigging links up and down within a drilling rig.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the invention should be limited only by the attached claims.

What is claimed is:

1. A system to secure a link in a drilling rig, the system comprising:

a tool comprising a top drive, the tool having a link ear and suspended within the drilling rig, the link ear configured to attach a first end of the link thereupon; and a carrier configured to removably secure at least a portion of the link;

wherein the first end of the link is accessible to attach to the link ear, and wherein the carrier comprises a securing mechanism to secure the link within the carrier.

2. The system of claim 1, wherein the carrier is configured to move with respect to the tool with the second end of the link secured within the carrier.

3. The system of claim 1, further comprising:

a track disposed on the drilling rig and adjacent to the tool;

wherein the carrier is configured to move along the track with respect to the tool with the link secured within the carrier.

4. The system of claim 1, wherein the carrier is configured to move along the rig floor with respect to the tool with link secured within the carrier.

5. The system of claim 1, wherein the carrier comprises a rolling member disposed on a bottom side thereof such that the carrier is configured to move with respect to the tool with the link secured within the carrier.

6. The system of claim 1, wherein the carrier is at least one of pneumatically actuated, hydraulically actuated, electrically actuated, and mechanically actuated.

7. The system of claim 1, wherein the carrier comprises an actuator coupled to a link retainer of the carrier and configured to move the link retainer with respect to the carrier.

8. The system of claim 1, wherein the carrier comprises an actuator coupled to a securing mechanism of the carrier and configured to move the securing mechanism with respect to the carrier.

9. The system of claim 1, wherein the carrier is configured to move the link within the carrier between an extended position and a retracted position, wherein, in the extended position, the first end of the link is accessible from outside of the carrier, and wherein, in the retracted position, the first end of the link is disposed within the carrier.

10. The system of claim 1, wherein the tool has a second link ear, the second link ear configured to receive a first end of a second link thereupon, wherein the carrier is configured to removably secure the second link, wherein the carrier is configured to have the first end of the second link accessible.

11. The system of claim 1, wherein the carrier is further configured to removably receive an elevator therein.

12. The system of claim 1, wherein the carrier is at least one of disposed on a rig floor of the drilling rig and disposed adjacent to the rig floor of the drilling rig.

13. An apparatus to secure a link in a drilling rig, the apparatus comprising:

a carrier configured to removably secure at least a portion of the link therein;

wherein the carrier is configured to have a first end of the link accessible outside of the carrier, wherein the carrier is configured to move the link within the carrier between an extended position and a retracted position, wherein, in the extended position, the first end of the link is accessible from outside of the carrier, and wherein, in the retracted position, the first end of the link is disposed within the carrier.

14. The apparatus of claim 13, wherein the carrier is configured to move with respect to a tool with the second end of the link secured within the carrier.

15. The apparatus of claim 13, wherein the carrier is configured to support the link along an axial length of the link.

16. The apparatus of claim 13, wherein the carrier comprises an elongate body configured to receive the at least portion of the link.

17. The apparatus of claim 13, wherein the carrier comprises a link retainer having an elongate shape configured to receive the at least portion of the link therein.

18. The apparatus of claim 13, wherein the carrier is configured to move with respect to the drilling rig with the link secured within the carrier.

19. The apparatus of claim 13, wherein the carrier comprises a rolling member disposed on a bottom side thereof such that the carrier is configured to move with respect to the drilling rig with the link secured within the carrier.

20. The apparatus of claim 13, wherein the carrier comprises a securing mechanism to secure the link within the carrier.

21. The apparatus of claim 13, wherein the carrier is at least one of pneumatically actuated, hydraulically actuated, electrically actuated, and mechanically actuated.

22. The apparatus of claim 13, wherein the carrier is further configured to removably receive an elevator therein.

23. A method to secure a link from a drilling rig, the method comprising:

providing a tool having a link ear within the drilling rig, the link ear having a first end of the link attached thereupon;

disposing a carrier adjacent to the tool;

receiving at least a portion of the link within the carrier such that the link is secured within the carrier, the receiving comprising:

receiving the link within a link retainer of the carrier; and securing the link within the link retainer with a securing mechanism of the carrier; and moving the carrier away from the tool with the link secured within the carrier.

24. The method of claim 23, wherein the moving the carrier away from the tool comprises at least one of:

moving the carrier along a track disposed within the drilling rig; and moving the carrier along a rig floor of the drilling rig.

25. The method of claim 23, wherein securing the link within the link retainer comprises at least one of:

moving the link retainer with respect to the carrier with a first actuator coupled to the link retainer; and moving the securing mechanism with respect to the carrier with a second actuator coupled to the securing mechanism.

26. The method of claim 23, wherein the receiving the at least portion of the link within the carrier comprises at least one of:

supporting the at least portion of the link along an axial length thereof with the carrier; and supporting the at least portion of the link with an elongate body of the carrier.

27. The method of claim 23, wherein the receiving the at least portion of the link within the carrier comprises:

moving the link within the carrier between an extended position and a retracted position;

wherein, in the extended position, the first end of the link is accessible from outside of the carrier; and wherein, in the retracted position, the first end of the link is disposed within the carrier.

28. The method of claim 23, wherein the receiving the at least portion of the link within the carrier comprises receiving an elevator within the carrier.

29. A method to secure a link to a drilling rig, the method comprising:

providing a tool having a link ear within the drilling rig, the link ear configured to have a first end of the link attached thereupon;

disposing a carrier adjacent to the tool, the carrier having the link removably received therein, wherein the carrier is configured to move the link within the carrier between an extended position and a retracted position, wherein, in the extended position, a first end of the link is accessible from outside of the carrier, and wherein, in the retracted position, the first end of the link is disposed within the carrier;

attaching the first end of the link to the link ear of the tool;

releasing the link from the carrier; and moving the carrier away from the tool with the link attached to the link ear of the tool.

30. The method of claim 29, further comprising at least one of:

supporting the at least portion of the link along an axial length thereof with the carrier; and supporting the at least portion of the link with an elongate body of the carrier.

31. The method of claim 29, wherein the moving the carrier away from the tool comprises at least one of:

moving the carrier along a track disposed within the drilling rig; and moving the carrier along a rig floor of the drilling rig.

32. The method of claim 29, wherein the releasing the link from the carrier further comprises releasing an elevator from the carrier.

* * * * *